US009995131B2

(12) United States Patent
Herrera

(10) Patent No.: US 9,995,131 B2
(45) Date of Patent: Jun. 12, 2018

(54) DOWNHOLE THERMAL COMPONENT TEMPERATURE MANAGEMENT SYSTEM AND METHOD

(75) Inventor: Adan Hernandez Herrera, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 848 days.

(21) Appl. No.: 13/121,087

(22) PCT Filed: Nov. 13, 2009

(86) PCT No.: PCT/US2009/064423

§ 371 (c)(1),
(2), (4) Date: May 17, 2011

(87) PCT Pub. No.: WO2010/057017

PCT Pub. Date: May 20, 2010

(65) Prior Publication Data

US 2011/0203798 A1 Aug. 25, 2011

Related U.S. Application Data

(60) Provisional application No. 61/114,454, filed on Nov. 13, 2008.

(51) Int. Cl.
*E21B 47/01* (2012.01)

(52) U.S. Cl.
CPC ..... *E21B 47/011* (2013.01)

(58) Field of Classification Search
CPC ..... E21B 36/001; E21B 47/011
(Continued)

(56) References Cited

U.S. PATENT DOCUMENTS 4,375,157 A * 3/1983 Boesen ..... 62/49.2
5,720,342 A * 2/1998 Owens ..... E21B 36/001 166/302

(Continued)

FOREIGN PATENT DOCUMENTS

GB 2477230 B 12/2012
WO 2006055099 A2 5/2006

(Continued)

OTHER PUBLICATIONS

PCT/US2009/064423 International Search Report and Written Opinion, dated Jun. 1, 2010 (14 p.).

(Continued)

*Primary Examiner* — D. Andrews
(74) *Attorney, Agent, or Firm* — Haynes & Boone, LLP

(57) ABSTRACT

A system for temperature management of a downhole thermal component includes a heat exchanger thermally coupled with the thermal component and a heat exhausting temperature management system thermally coupled with the thermal component and the heat exchanger to transfer heat from the thermal component to the heat exchanger. The system may include an electrical device coupled between the thermal component and the heat exchanger and a power source to provide an energy flow to the electrical device to transfer heat from the thermal component to the heat exchanger. The system may include a thermoelectric cooler coupled between the thermal component and the heat exchanger. A method includes energizing an electrical device or a thermoelectric cooler to transfer heat from the thermal component to the heat exchanger.

14 Claims, 4 Drawing Sheets

(58) Field of Classification Search
USPC ..... 166/302, 57, 65.1
See application file for complete search history.

(56) References Cited

U.S. PATENT DOCUMENTS

| | | | | |
|---|---|---|---|---|
| 5,931,000 | A * | 8/1999 | Turner et al. | 62/3.2 |
| 6,176,323 | B1 * | 1/2001 | Weirich | E21B 21/08 175/40 |
| 7,308,795 | B2 * | 12/2007 | Hall | E21B 47/011 166/66 |
| 7,440,283 | B1 * | 10/2008 | Rafie | 361/709 |
| 2006/0162931 | A1 | 7/2006 | Mayes | |
| 2006/0213660 | A1 | 9/2006 | DiFoggio et al. | |

FOREIGN PATENT DOCUMENTS

| | | | |
|---|---|---|---|
| WO | 2006074393 | A1 | 7/2006 |
| WO | WO 2010/014243 | A2 | 2/2010 |

OTHER PUBLICATIONS

Modified Substantive Examination Adverse Report issued for Malaysian Patent Application No. PI 2011001479 dated May 13, 2016, 4 pages.
Australian Government IP Australia, Patent Examination Report No. 1, dated Mar. 16, 2015, 3 pages.

* cited by examiner

SECTION B-B

DOWNHOLE THERMAL COMPONENT TEMPERATURE MANAGEMENT SYSTEM AND METHOD

CROSS-REFERENCE TO RELATED APPLICATIONS

This application is a 35 U.S.C. § 371 national stage application of PCT/US2009/064423 filed Nov. 13, 2009, which claims the benefit of U.S. Provisional Patent Application No. 61/114,454 filed Nov. 13, 2008, both of which are incorporated herein by reference in their entireties for all purposes.

BACKGROUND

To drill a well, a drill bit bores thousands of feet into the crust of the earth. The drill bit typically extends downward from a drilling platform on a string of pipe, commonly referred to as a "drill string." The drill string may be jointed pipe or coiled tubing, through which drilling fluid is pumped to cool and lubricate the bit and lift the drill cuttings to the surface. At the lower, or distal, end of the drill string is a bottom hole assembly (BHA), which includes, among other components, the drill bit.

In order to obtain measurements and information from the downhole environment while drilling, the BHA includes electronic instrumentation. Various tools on the drill string, such as logging-while-drilling (LWD) tools and measurement-while-drilling (MWD) tools incorporate the instrumentation. Such tools on the drill string contain various electronic components incorporated as part of the BHA. These electronic components generally consist of computer chips, circuit boards, processors, data storage, power converters, and the like.

Downhole tools must be able to operate near the surface of the earth as well as many hundreds of meters below the surface. Environmental temperatures tend to increase with depth during the drilling of the well. As the depth increases, the tools are subjected to a severe operating environment. For example, downhole temperatures are generally high and may even exceed 200° C. In addition, pressures may exceed 138 MPa. There is also vibration and shock stress associated with operating in the downhole environment, particularly during drilling operations.

The electronic components in the downhole tools also internally generate heat. For example, a typical wireline tool may dissipate over 100 watts of power, and a typical downhole tool on a drill string may dissipate over 10 watts of power. While performing drilling operations, the tools on the drill string typically remain in the downhole environment for periods of several weeks. In other downhole applications, drill string electronics may remain downhole for as short as several hours to as long as one year. For example, to obtain downhole measurements, tools are lowered into the well on a wireline or a cable. These tools are commonly referred to as "wireline tools." However, unlike in drilling applications, wireline tools generally remain in the downhole environment for less than twenty-four hours.

A problem with downhole tools is that when downhole temperatures exceed the temperature of the electronic components, the heat cannot dissipate into the environment. The heat may accumulate internally within the electronic components and this may result in a degradation of the operating characteristics of the component or may result in a failure. Thus, two general heat sources must be accounted for in downhole tools, the heat incident from the surrounding downhole environment and the heat generated by the tool components, e.g., the tool's electronics components.

While the temperatures of the downhole environment may exceed 200° C., the electronic components are typically rated to operate at no more than 125° C. Thus, exposure of the tool to elevated temperatures of the downhole environment and the heat dissipated by the components may result in the degradation of the thermal failure of those components. Generally, thermally induced failure has at least two modes. First, the thermal stress on the components degrades their useful lifetime. Second, at some temperature, the electronics may fail and the components may stop operating. Thermal failure may result in cost not only due to the replacement costs of the failed electronic components, but also because electronic component failure interrupts downhole activities. Trips into the borehole also use costly rig time.

One method for managing the temperature of thermal components in a downhole tool includes a heat storing temperature management system. Heat storing temperature management involves removing heat from the thermal component and storing the heat in another element of the heat storing temperature management system, such as a heat sink. However, storing heat with a heat sink has certain limitations in the downhole environment, including keeping heat stored adjacent the thermal component. The principles of the present disclosure are directed to overcoming these and other limitations in the prior art, including using a heat exhausting temperature management system to remove heat from the thermal component and transfer the heat to the environment outside the thermal component temperature management system, such as to the drill string or to the drilling fluid inside or outside the drill string.

BRIEF DESCRIPTION OF THE DRAWINGS

For a more detailed description of the embodiments, reference will now be made to the following accompanying drawings.

DETAILED DESCRIPTION OF THE EMBODIMENTS

The present disclosure relates to a thermal component temperature management system and includes embodiments of different forms. The drawings and the description below disclose specific embodiments with the understanding that the embodiments are to be considered an exemplification of the principles of the disclosure, and are not intended to limit the disclosure to that illustrated and described. Further, it is to be fully recognized that the different teachings of the embodiments discussed below may be employed separately or in any suitable combination to produce desired results. The term "couple," "couples," or "thermally coupled" as used herein is intended to mean either an indirect or a direct connection. Thus, if a first device couples to a second device, that connection may be through a direct connection; e.g., via conduction through one or more devices, or through an indirect connection; e.g., via convection or radiation. The term "temperature management" as used herein is intended to mean the overall management of temperature, including maintaining, increasing, or decreasing temperature and is not meant to be limited to only decreasing temperature.

FIGS. 1A-1C and 2A-2C illustrate a first embodiment of a temperature management system 10 for disposal in a downhole tool such as on a drill string for drilling a borehole in a formation. Other tool conveyances, as previously noted, are contemplated, such as wired pipe, coiled tubing, wired coiled tubing, and others. The temperature management system 10 might also be used in a downhole wireline tool, a permanently installed downhole tool, or a temporary well testing tool. Downhole, the ambient temperature may sometimes exceed 200° C. However, the temperature management system 10 may also be used in other situations and applications where the surrounding environment ambient temperature is either greater than or less than that of the thermal components being cooled.

The temperature management system 10 manages the temperature of at least one thermal component 12 that may, e.g., be mounted on at least one board in the downhole tool. The thermal component 12 includes, but is not limited to, heat-dissipating components, heat-generating components, and/or heat-sensitive components. An example of a thermal component 12 may be an integrated circuit, e.g., a computer chip, or other electrical or mechanical device that is heat-sensitive or whose performance is deteriorated by high temperature operation, or that generates heat.

Figure 1A:
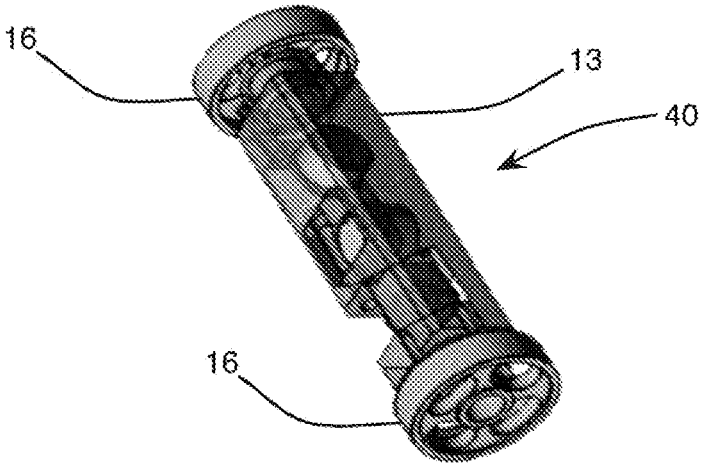
FIGS. 1A-1C illustrate a temperature management system with an electrical heat transfer device according to a first embodiment.
Figure 1B:
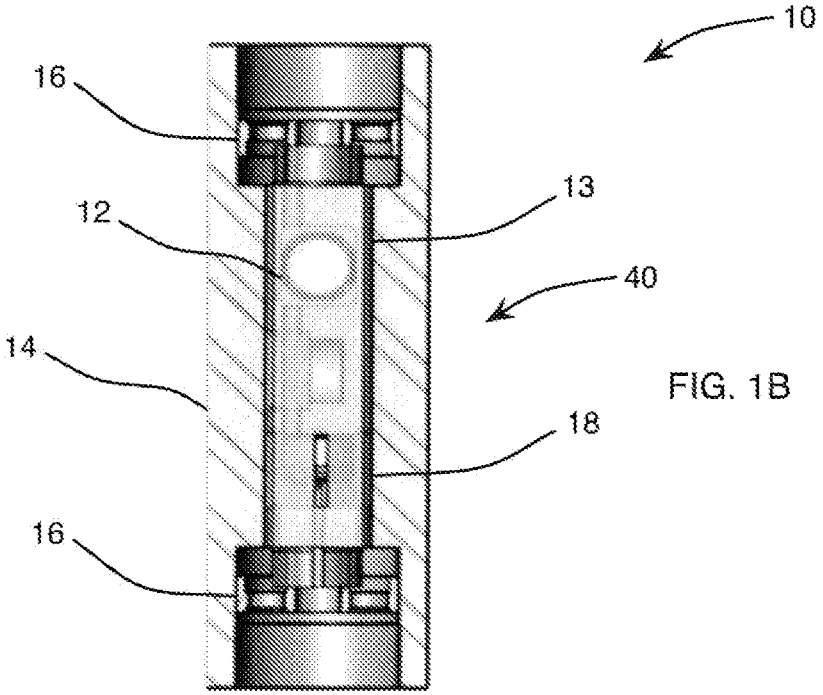
Figure 1C:
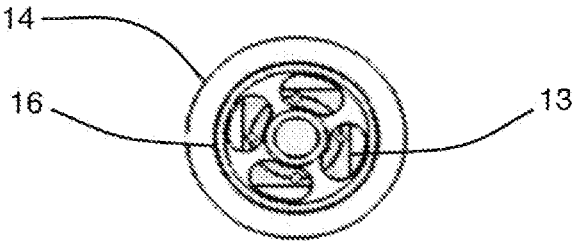

Referring to FIG. 1A, the thermal component board may be mounted on a chassis 13. In some embodiments, the chassis 13 is a heat spreading chassis. As shown in FIGS. 1B and 1C, the chassis 13 is installed within a heat exchanger 14 of the downhole tool using isolation mounts 16. As shown, the heat exchanger 14 includes a body with a central passageway and an outer cylindrical surface to receive the chassis 13 and the mounts 16 for installation and mounting.

The temperature management system 10 also includes a heat exhausting temperature management system 40 that removes heat from the chassis 13 and transfers the heat to the heat exchanger 14. In one embodiment, the heat exhausting temperature management system 40 includes the chassis 13 and mounts 16 assembly as shown in FIG. 1A. As shown in FIG. 1B, at least one electrical heat transfer device 18 is mounted on the chassis 13 prior to installation of the chassis and mount assembly. Then, the chassis and mount assembly complete with the electrical heat transfer device 18 is installed in the heat exchanger 14 to form the heat exhausting system 40 of the temperature management system 10. Because of the arrangement of the chassis 13 inside the heat exchanger 14, in one aspect the system 10 is a canister cooling configuration. In some embodiments, the electrical heat transfer device 18 is a thermoelectric cooler. In some embodiments, the electrical heat transfer device or the thermoelectric cooler use a thermal interface material to contact and thermally engage surrounding components, such as the heat exchanger, and as more fully described below.

Figure 2A:
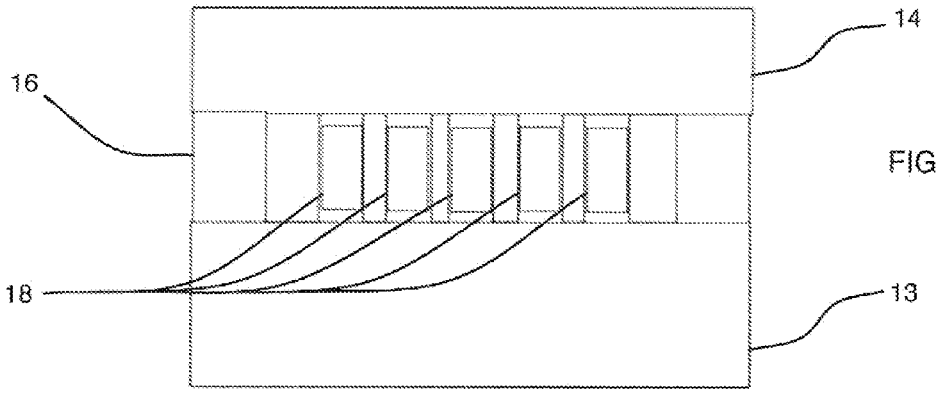
FIGS. 2A-2C illustrate thermoelectric cooler configurations for use in various temperature management systems in accordance with principles herein.
Figure 2B:
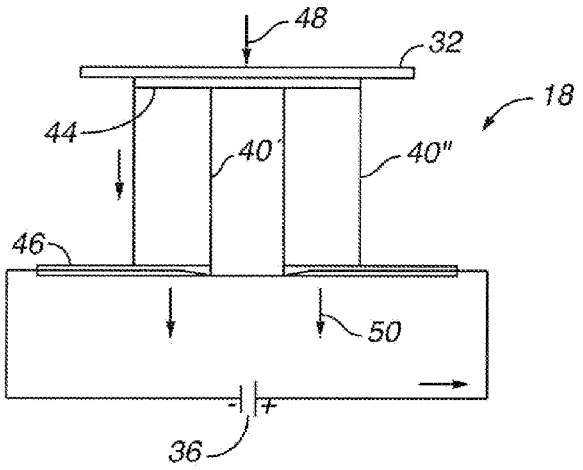
Figure 2C:
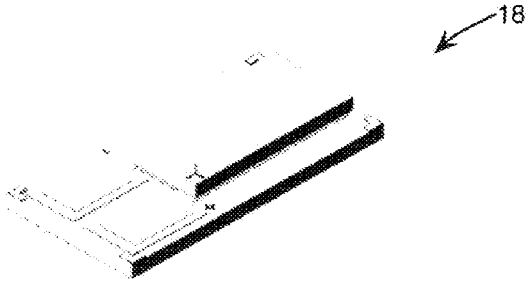

As shown in FIGS. 2A-2C, the thermoelectric cooler 18 includes, e.g., a hot plate 46 and a cold plate 44. The heat exhausting temperature management system 40 may also comprise a multiple stage thermoelectric temperature management system. The thermoelectric cooler 18 may include two different types of semiconductors 40' and 40," each made of dissimilar materials, thermally coupled between the cold plate 44 and the hot plate 46 as shown in FIG. 2B. In some embodiments, the semiconductor 40' is a p-type silicon semiconductor and the semiconductor 40" is an n-type silicon semiconductor. In some embodiments, the cold plate 44 and the hot plate 46 are made from a ceramic material. The semiconductors 40' and 40" are connected electrically in series and thermally in parallel. A power source 36 provides energy for the thermoelectric cooler 18. When a positive voltage from the power source 36 is applied to the n-type semiconductor 40", the circuit is energized and electrons pass from the low energy p-type semiconductor 40' to the high energy n-type semiconductor 40". In so doing, the electrons absorb energy 48 (i.e., heat). As the electrons pass from the high energy n-type semiconductor 40" to the low energy p-type semiconductor 40', heat is expelled at 50. Thus, heat energy 48 is initially transferred from a heat source to the cold junction, or cold plate 44. This heat is then transferred by the semiconductors to the hot junction, or hot plate 46, and then further transferred at 50. The heat transferred is proportional to the current and the number of thermoelectric couples. As used herein, the term "thermoelectric cooler" includes both a single stage thermoelectric cooler, as well as multistage and cascaded arrangements of multiple thermoelectric cooler stages.

The cold plate 44 of the heat exhausting temperature management system 40 is thermally coupled with the chassis 13. The heat exhausting temperature management system 40 removes heat 48 from the chassis 13 at the cold plate 44 and transfers the removed heat to the hot plate 46. From the hot plate 46, the heat 50 is transferred to the heat exchanger 14. In some embodiments, a thermal interface material is used such as thermal interface material 32. The heat may then be transferred to the drill string, the annulus between the downhole tool and the formation, or the drilling fluid being pumped through the drill string and the downhole tool. The heat may be transferred from the hot plate 46 to the environment directly through conduction or indirectly through convection or radiation, or any combination of direct and indirect transfer. The heat exhausting temperature management system 40 allows removed heat to be transferred to the drilling fluid even though the drilling fluid may be at a higher temperature than the thermal component 12. The heat exhausting temperature management system 40 may also comprise more than one thermoelectric cooler 18 thermally coupled with the chassis 13.

Power for the thermal component 12 and the thermoelectric cooler 18 may be supplied by a turbine alternator, which is driven by the drilling fluid pumped through the drill string. The turbine alternator may be of the axial, radial, or mixed flow type. Alternatively, the alternator may be driven by a positive displacement motor driven by the drilling fluid, such as a Moineau-type motor. It is understood that other power supplies, such as batteries or power from the surface, may also be used.

The temperature management system 10 removes enough heat to maintain the thermal component 12 at or below its rated temperature, which may be, e.g., no more than 125° C. For example, the temperature management system 10 may maintain the component 12 at or below 100° C., or even at or below 80° C. Typically, the lower the temperature, the longer the life of the thermal component 12.

Thus, the temperature management system 10 manages the temperature of the thermal component 12 using the heat exhausting system 40, which can be driven electrically. Absorbing heat from the thermal component 12 thus extends the useful life of the thermal component 12 at a given environment temperature. In some embodiments, the system includes a heat exchanger thermally coupled with the thermal component and a heat exhausting temperature management system thermally coupled with the thermal component and the heat exchanger to transfer heat from the thermal component to the heat exchanger. The heat exhausting temperature management system may include an electrical device coupled between the thermal component and the heat exchanger, and wherein the electrical device is coupled to a power source to provide an energy flow to the electrical device to transfer heat from the thermal component to the heat exchanger. The heat exhausting temperature management system may include a thermoelectric cooler coupled between the thermal component and the heat exchanger. The thermoelectric cooler may include a cold plate thermally coupled to the thermal component and a hot plate thermally coupled to the heat exchanger. The thermoelectric cooler may further include a first and a second semiconductor coupled between the cold and hot plates, wherein the semiconductors are made of dissimilar silicons or other dissimilar materials. The thermoelectric cooler may include an electrical power source to energize the first and second semiconductors, and wherein the energized first and second semiconductors transfer heat from the cold plate to the hot plate. A method may include thermally coupling the thermal component with a heat exchanger, thermally coupling a heat exhausting temperature management system with the thermal component and the heat exchanger, and transferring heat from the thermal component to the heat exchanger using the heat exhausting temperature management system. The method may further include energizing an electrical device to transfer heat from the thermal component to the heat exchanger. The method may further include coupling first and second semiconductors of dissimilar materials between cold and hot plates, and energizing the semiconductors to transfer heat from the cold plate to the hot plate. The method may further include transferring heat from the heat exchanger to a drill string, a fluid flow in an annulus between a downhole tool and a formation, a fluid flow in a flow bore of the drill string and the downhole tool, or a combination thereof.

In some embodiments, the thermal component is installed within the heat exchanger. The thermal component may be mounted on a heat spreading chassis that is received within a cylindrical body of the heat exchanger. The system may further include isolation mounts coupled to each end of the heat exchanger to install the thermal component within the heat exchanger.

Figure 3A:
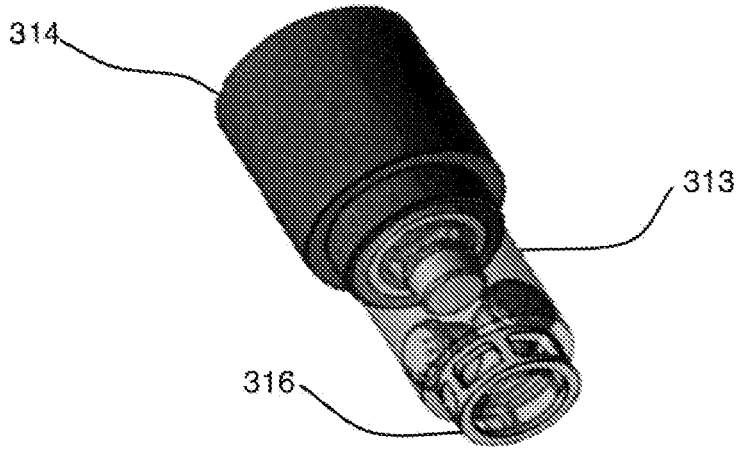
FIGS. 3A-3C illustrate a second embodiment of a temperature management system with electrical heat transfer.
Figure 3B:
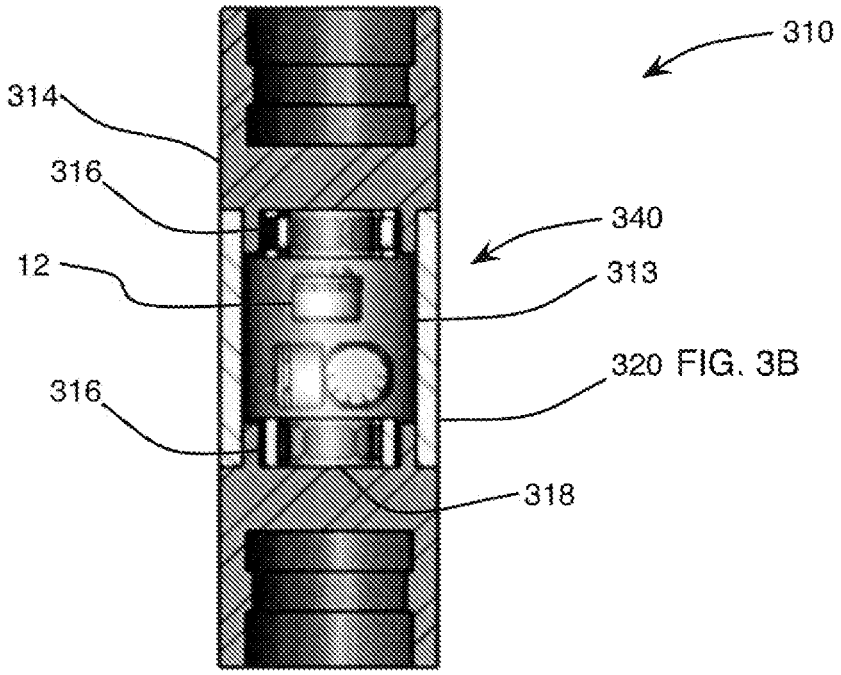
Figure 3C:
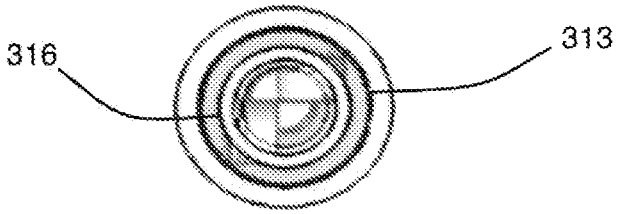
Figure 4A:
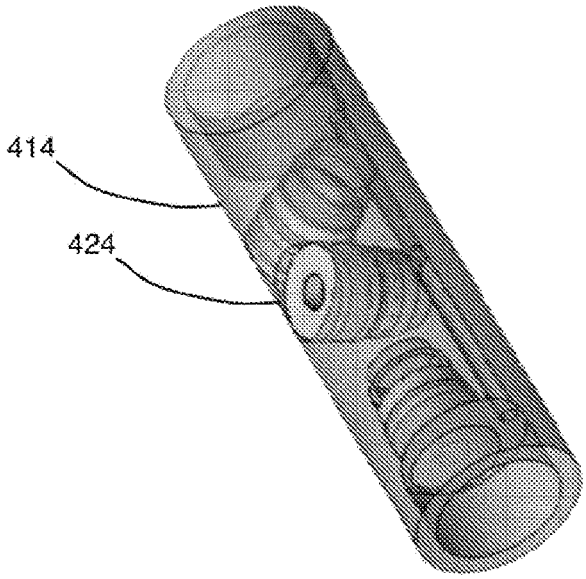
FIGS. 4A-4D illustrate a third embodiment of a temperature management system with electrical heat transfer.
Figure 4B:
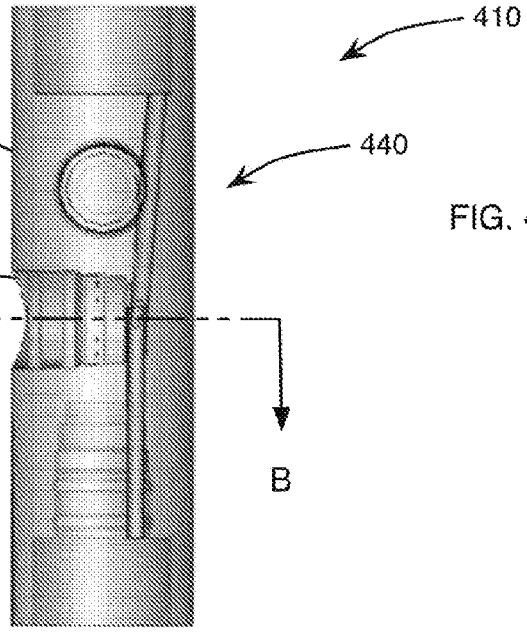
Figure 4D:
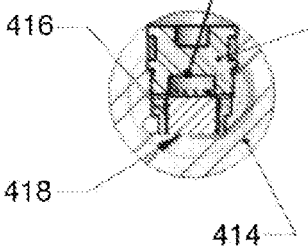
Figure 4C:
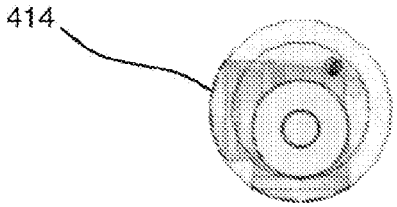

FIGS. 3A-3B illustrate a second embodiment of a temperature management system 310. As with the temperature management system 10, the temperature management system 310 manages the temperature of a thermal component 12 mounted, e.g., on a board in the downhole tool. The temperature management system 310 also includes a heat exchanger 314 thermally coupled with the thermal component 12 as with the temperature management system 10. In some embodiments, and as shown in FIGS. 3A and 3B, the heat exchanger 314 may be separated into two components, such as upper and lower components coupled to ends of an inner thermal component assembly. The temperature management system 310 also includes a heat exhausting temperature management system 340. However, in the temperature management system 310, the heat exhausting temperature management system 340 includes at least one electrical heat transfer device or thermoelectric cooler 318 used with a thermal interface material in a pancake cooling configuration on the outer side of an isolation mount 316. Outside of and surrounding a chassis 313 is an insulator sleeve 320. The inner assembly formed by the insulator sleeve 320, the chassis 313, the isolation mounts 316, the thermoelectric cooler 318, and the thermal component 12 is captured by the two mating components of the heat exchanger 314 as shown. The thermoelectric cooler 318 may include the same components and operate in a similar manner as the thermoelectric cooler 18 described above.

The heat exhausting temperature management system 340 removes heat from the chassis 313 and transfers the removed heat to the heat exchanger 314. The heat may then be transferred to the drill string, the annulus between the downhole tool and the formation, or the drilling fluid being pumped through the drill string and the downhole tool. The heat may be transferred to the environment directly through conduction or indirectly through convection or radiation, or any combination of direct and indirect transfer. The heat exhausting temperature management system 340 allows removed heat to be transferred to the drilling fluid even though the drilling fluid may be at a higher temperature than the thermal component 12. The heat exhausting temperature management system 340 may also comprise more than one thermoelectric cooler 318 thermally coupled with the chassis 313 and supported by the isolation mounts 316.

Power for the thermal component 12 and the thermoelectric cooler 318 may be supplied by a turbine alternator, which is driven by the drilling fluid pumped through the drill string. The turbine alternator may be of the axial, radial, or mixed flow type. Alternatively, the alternator may be driven by a positive displacement motor driven by the drilling fluid, such as a Moineau-type motor. It is understood that other power supplies, such as batteries or power from the surface, may also be used.

The temperature management system 310 removes enough heat to maintain the thermal component 12 at or below its rated temperature, which may be, e.g., no more than 125° C. For example, the temperature management system 10 may maintain the component 12 at or below 100° C., or even at or below 80° C. Typically, the lower the temperature, the longer the life of the thermal component 12.

Thus, the temperature management system 310 manages the temperature of the thermal component 12 using the heat exhausting system 340, which can be driven electrically. Absorbing heat from the thermal component 12 thus extends the useful life of the thermal component 12 at a given environment temperature. In some embodiments, the thermal component is installed between two components of the heat exchanger. The thermal component may be mounted on a cylindrical heat spreading chassis that is coupled between the two components of the heat exchanger. The system may further include an insulator sleeve surrounding the cylindrical chassis. The system may further include isolation mounts coupled between each end of the cylindrical chassis and the two heat exchanger components.

FIGS. 4A-4D illustrate a third embodiment of a temperature management system 410. As with the temperature management system 10 and 310, the temperature management system 410 manages the temperature of a thermal component 12 mounted in the downhole tool. The temperature management system 410 also includes a heat exchanger 414 thermally coupled with the thermal component 12. In some embodiments, the heat exchanger 314 is a cylindrical body with one or more ports and one or more passageways. The temperature management system 410 also includes a heat exhausting temperature management system 440. However, in the temperature management system 410, the heat exhausting temperature management system 440 includes at least one electrical heat transfer device or thermoelectric cooler 418 used with a thermal interface material in a ported cooling configuration wherein the thermoelectric cooler 418 and the thermal component 12 are located within mini-flasks or ports 424 in the heat exchanger 414. For each flask or port 424, a cap 422 secures an insulation mount 416 to which the thermal component 12 is mounted. Thus, the thermoelectric cooler 418 is located between the thermal component 12 and the inner portion of the port 424 of the heat exchanger 414. The thermoelectric cooler 418 may include the same components and operate in a similar manner as the thermoelectric coolers 18 and 318 described above. Also, connected to the several ports 424 are passageways or inner ports.

The heat exhausting temperature management system 440 removes heat from the thermal component 12 and transfers the removed heat to the heat exchanger 414. The heat may then be transferred to the drill string, the annulus between the downhole tool and the formation, or the drilling fluid being pumped through the drill string and the downhole tool. The heat may be transferred to the environment directly through conduction or indirectly through convection or radiation, or any combination of direct and indirect transfer. The heat exhausting temperature management system 440 allows removed heat to be transferred to the drilling fluid even though the drilling fluid may be at a higher temperature than the thermal component 12. The heat exhausting temperature management system 440 may also comprise more than one thermoelectric cooler 418 thermally coupled with the thermal component 12.

Power for the thermal component 12 and the thermoelectric cooler 418 may be supplied by a turbine alternator, which is driven by the drilling fluid pumped through the drill string. The turbine alternator may be of the axial, radial, or mixed flow type. Alternatively, the alternator may be driven by a positive displacement motor driven by the drilling fluid, such as a Moineau-type motor. It is understood that other power supplies, such as batteries or power from the surface, may also be used.

The temperature management system 410 removes enough heat to maintain the thermal component 12 at or below its rated temperature, which may be, e.g., no more than 125° C. For example, the temperature management system 10 may maintain the component 12 at or below 100° C., or even at or below 80° C. Typically, the lower the temperature, the longer the life of the thermal component 12.

Thus, the temperature management system 410 manages the temperature of the thermal component 12 using the heat exhausting system 440, which can be driven electrically. Absorbing heat from the thermal component 12 thus extends the useful life of the thermal component 12 at a given environment temperature. In some embodiments, the thermal component is installed in a port in the heat exchanger. The thermal component may be secured in the port by a cap. The system may further include a thermoelectric cooler disposed between the cap-secured thermal component and the heat exchanger. The system may further include an insulation mount coupled between the cap and the heat exchanger to support the thermoelectric cooler.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A system for temperature management of a downhole thermal component, comprising:

a heat exchanger comprising:

a first axial end;

a second axial end opposite the first axial end; and an exterior radial surface extending between the first and second axial ends, wherein an axis of the heat exchanger extends through the first and second axial ends;

a first port positioned in the heat exchanger and extending out to the exterior radial surface, the first port connected to an eccentrically positioned inner passageway running axially the length of the heat exchanger;

a thermal component positioned inside the first port; and a heat transfer device positioned between the heat exchanger and the thermal component to thereby transfer heat from the thermal component to the heat exchanger;

a second port extending along the axis of the heat exchanger and connected to the eccentrically positioned inner passageway, the second port in connection with an interior chamber of the heat exchanger extending from an end of the second port to the second axial end.

2. A system as defined in claim 1, wherein the thermal component is secured in the first port by a cap.

3. A system as defined in claim 2, further comprising an insulation mount coupled between the cap and the heat exchanger.

4. A system as defined in claim 3, wherein the insulation mount is configured to restrict heat transfer.

5. A system as defined in claim 1, wherein at least one of the first and second ends of the heat exchanger are coupled to a drill string or wireline assembly.

6. A system as defined in claim 1, wherein the heat transfer device is a thermoelectric cooler.

7. A downhole system for temperature management of a thermal component, comprising:

a first heat exchanger component having an outer cylindrical first heat transfer surface defining an axis extending through a first axial end and a second axial end;

a first port formed within said first heat exchanger component, the first port extending to an exterior radial surface of said first heat exchanger component and defining a generally planar second heat transfer surface of said first heat exchanger component;

a first chassis carrying a first thermal component;

a first thermoelectric cooler having a first semiconductor and a second semiconductor made of dissimilar materials carried by said first chassis and thermally coupled between said first thermal component and said second heat transfer surface; and a second port formed and extending within said first heat exchanger component and defining a generally planar third heat transfer surface of said first heat exchanger component;

wherein said second port is connected to an eccentrically positioned inner passageway running axially the length of said first heat exchanger component and is in connection with an interior chamber of the first heat exchanger component extending from an end of the second port to the second axial end of the first heat exchanger component.

8. A system as defined in claim 7, further comprising:

a second chassis carrying a second thermal component; and a second thermoelectric cooler carried by said second chassis and thermally coupled between said second thermal component and said third heat transfer surface of said first heat exchanger component.

9. A system as defined in claim 8, further comprising:

said first chassis is received within said first port; and said second chassis is received within said second port.

10. A system as defined in claim 8, wherein:

said first port is radially formed within said first heat exchanger component and defines said generally planar second heat transfer surface oriented parallel to said axis; and said second port is longitudinally formed within said first heat exchanger component and defines said generally planar third heat transfer surface oriented normal to said axis.

11. A system as defined in claim 7, further comprising:

said first chassis is received within said first port.

12. A system as defined in claim 7, wherein the first heat exchanger component is coupled to a drill string or wireline assembly.

13. A system as defined in claim 7, wherein:

said first port is radially formed within said first heat exchanger component and defines said generally planar second heat transfer surface oriented parallel to said axis.

14. A system as defined in ciaim 7, wherein:

said first chassis includes a cap that seals said first thermal component and said first thermoelectric cooler within said first port from the outer cylindrical first heat transfer surface.

* * * * *